752-99 AU 162 EX
12/7/82 XR 4,362,641

United States Patent [19]

Peterson

[11] 4,362,641

[45] Dec. 7, 1982

[54] COMPOSITION OF AN STPP PRODUCT FOR DISHWASHER DETERGENT FORMULATIONS AND METHOD OF PREPARATION

[75] Inventor: John A. Peterson, Niagara Falls, N.Y.

[73] Assignee: Occidental Chemical Corporation, Niagara Falls, N.Y.

[21] Appl. No.: 302,934

[22] Filed: Sep. 16, 1981

Related U.S. Application Data

[63] Continuation of Ser. No. 129,761, Mar. 12, 1980, abandoned.

[51] Int. Cl.[3] ..... C11D 3/06; C11D 7/16; C11D 11/00; C11D 17/06

[52] U.S. Cl. ..... 252/135; 252/99; 252/175; 423/315

[58] Field of Search ..... 423/305, 315; 252/99, 252/109, 135, 175

[56] References Cited

U.S. PATENT DOCUMENTS

| | | | |
|---|---|---|---|
| 2,712,529 | 7/1955 | Mills | 252/135 |
| 2,961,409 | 11/1960 | Martin | 252/135 |
| 2,961,410 | 11/1960 | Martin | 252/135 |
| 2,977,317 | 3/1961 | Rodis | 252/135 |
| 3,169,930 | 2/1965 | Gedge | 252/135 |
| 3,233,967 | 2/1966 | Shen | 252/135 |
| 3,437,433 | 4/1969 | Sproul | 423/315 |
| 3,461,074 | 8/1969 | Schwalley | 252/135 |
| 3,469,938 | 9/1969 | McLeod | 423/315 |
| 3,932,590 | 1/1976 | Pals | 423/315 |

*Primary Examiner*—Dennis L. Albrecht
*Attorney, Agent, or Firm*—James F. Tao; William G. Gosz

[57] ABSTRACT

This invention is concerned with compositions of granular sodium tripolyphosphate (STPP) and their manufacture, which are suitable for use in the manufacture of automatic dishwasher detergents. The granular STPP compositions contain an overall 30 to 40% by weight of the STPP Phase I modification and no more than 5% of the granules composing the composition shall be of both +50 mesh size and under 25% Phase I concentration. Particle size of the total composition is 10% maximum of both +20 mesh and −100 mesh fractions. Apparent density is 0.7 to 0.9 grams per cubic centimeter. Such compositions are made by using only STPP materials in the 30 to 40% range or by mixing −50 mesh fractions of lower Phase I material with coarser fractions of higher Phase I material so that Phase I content of the total mixture is 30 to 40%.

4 Claims, No Drawings

COMPOSITION OF AN STPP PRODUCT FOR DISHWASHER DETERGENT FORMULATIONS AND METHOD OF PREPARATION

This is a continuation, of application Ser. No. 129,761, filed Mar. 12, 1980, now abandoned.

BACKGROUND OF THE INVENTION

The present invention relates to the design of mixtures of sodium tripolyphosphate (STPP) for incorporation into detergents for use in automatic dishwashing machines, especially those designed for home use.

The detergent composition used in home automatic dishwashing machines is designed to remove dirt, food particles, and other organic materials so that the dishware will be visibly clean and effectively sterilized upon completion of the washing cycle of the machine.

A major component in many dishwashing detergents is an alkali metal polyphosphate, especially STPP. The selection of the proper polyphosphate for use in a formulation is dependent upon many factors, some of which are solubility, density, noncorrosive properties, sequestering and water-softening capacity, enhancement of cleaning function in the end use, as well as properties which assist the manufacture and stability of the final detergent product. STPP has been accepted by the formulators of dishwasher detergent mixtures as meeting many or all of the above requirements, as well as being quite economically beneficial to the formulation.

STPP is known in both the anhydrous and hexahydrate form. Two phases, or forms, of the anhydrous compound are known; Phase I is formed at high calcining temperatures, and Phase II is formed at lower temperatures. The solutions of Phase I and Phase II STPP will be identical, although the two phases differ in their hydration and dissolution properties. Phase I STPP will dissolve rapidly in water and will exhibit a high heat of hydration to form the hexahydrate. Phase II STPP will dissolve slowly in water and exhibits a lower heat of hydration. Generally speaking, Phase II STPP can be added to unagitated water without undue caking or lumping. Phase I STPP, when added to poorly agitated water, tends to lump or cake together as it forms a strongly supersaturated solution from which hexahydrate crystals are rapidly deposited. Commercial production has been directed towards producing mixtures of Phase I and Phase II STPP that will utilize these relative property differences for the improvement of manufacturing processes of laundry detergents. The mixtures of Phase I and Phase II STPP are prepared by variations in the relationship of calcining temperatures and time.

Detergent for automatic dishwashing machines is usually prepared by selecting a mixture of inorganic salts such as alkali metal polyphosphates, including tetrasodium pyrophosphate and STPP, and other salts such as sodium silicates, sodium sulfates, and sodium carbonates. To a mixture of the above, chlorine-containing materials, such as chlorinated trisodium phosphate or chloroisocyanurate salts, and surface active agents are added. Dyes and perfumes are added for product indentification and consumer appeal. The exact formulation will vary from manufacturer-to-manufacturer; however, the bulk density of the final product must be closely controlled since the automatic dispensers of automatic dishwashing machines are designed to operate and clean the dishware most efficiently when the detergent has a bulk density of at least 0.6 grams per cubic centimeter.

A method of manufacture of a dishwasher detergent is to add selected components in an aqueous solution or suspension to anhydrous granular STPP which is optionally mixed with other solid components such as chlorinated trisodium phosphate. Solutions of sodium silicate, a desirable component in the final detergent product, are added and serve as an agglomerating agent at this stage of the process. To prevent liquification or excessive lumping of the mixture, a portion of the free water present must be removed by reaction with STPP to form solid STPP hexahydrate. To enable this "dehydrating" reaction, the granular STPP particles must be readily penetrated by water from the aqueous mixture coating them or by some other means must be capable of allowing ready access of free water to anhydrous STPP.

Overheating of the formulation mixture, caused by heat of hydration of STPP, is to be avoided if chlorinated trisodium phosphate is present in the mixture. The material will melt in the vicinity of 50° C., causing release of excessive free water and loss of active chlorine values.

Following the mixing step, the formulation is subjected to further processing steps which may include conditioning, drying, and sizing. Some free water may still be present in the final packaged product. Anhydrous STPP will need to be present and accessible to continue its functions as "dehydrating agent" by formation of STPP hexahydrate.

One object of this invention is to design a granular STPP product in which the Phase I/Phase II ratio in selected particle size fractions is such that the anhydrous STPP remains accessible for removal of free water by hydrate formation during the mixing step and, if necessary, on into the packaged product stage. Another object of this invention is to prepare a granular STPP product of a Phase I/Phase II ratio that will not cause overheating of the initial mixture in the formulation of automatic dishwasher detergent. An additional object of this invention is to provide the STPP product of an apparent density of 0.7 to 0.9 grams per cubic centimeter, found widely acceptable in the formulation of automatic dishwasher detergents.

While the above objectives may be applied to an STPP product made by several substantially different manufacturing methods, this invention is particularly applicable to STPP made by the method which employs a spray dryer as described below.

SUMMARY OF THE INVENTION

Compositions of granular sodium tripolyphosphate which are suitable for use in the manufacture of automatic dishwasher detergents contain an overall 30 to 40% by weight of the STPP Phase I modification and no more than 5% of the granules composing the composition shall be of both +50 mesh size and under 25% Phase I concentration. Particle size of the total composition is 10% maximum of both +20 mesh and −100 mesh fractions. Apparent density is 0.7 to 0.9 grams per cubic centimeter. Such compositions are made by using only STPP materials in the 30 to 40% range or by mixing −50 mesh fractions of lower Phase I material with coarser fractions of higher Phase I material to that Phase I content of the total mixture is 30 to 40%.

DETAILED DESCRIPTION OF THE INVENTION

Automatic dishwashing machine detergent generally contains as one major ingredient an alkali metal polyphosphate. STPP is used in most of the dishwashing detergents as this component.

This invention is particularly useful when dealing with the STPP product that is made starting with a spray during step. In this operation, a concentrated sodium phosphate solution, adjusted to a sodium ion/phosphate ion ratio of 5/3, is sprayed into a tower and dryed by contact with hot gases. The product of this step consists of sodium ortho and polyphosphates primarily in the form of hollow beads. This material is calcined to bring about essentially complete conversion to STPP, typically in a rotary kiln. STPP of primarily Phase I modification is made if calcination temperature reaches the 500° to 600° C. range while a primarily Phase II STPP results from temperatures under 400° C. Product of various Phase I/Phase II ratios may be made between 400° and 500° C. with Phase I increasing as temperature is increased. Agglomeration of the feed solids to a larger average particle size may be done by addition of the above sodium phosphate solution to the solids bed in the kiln. This addition also can bring about a desirable increase in apparent density.

Manufacturers of STPP can regulate the average Phase I content of their product by adjustment of calcination temperature, feed rate and other factors dependent upon the particular equipment used and residence time therein. This is done to meet the particular range found preferable for a particular end-use and specified by the user, e.g., a formulator of laundry detergents. While Phase I content can be quite sensitive to fairly small changes in temperature and may vary during a given production period, an acceptable product for most uses within a specified percent-Phase I range is made by balancing lower and higher Phase I content materials to achieve the desired average.

Particle size determination of the STPP in this invention was determined by using U.S. Standard screens. A +40 mesh sample would indicate that the material was retained on a 40 mesh screen, while a −40 mesh sample indicates that the material passed through a 40 mesh screen. Therefore, a notation describing a sample having the size −16/+40 would identify the material that passed a 16 mesh screen and was retained upon a 40 mesh screen.

Samples of STPP were taken from products of a plant which employed spray drying as the initial step. These samples ranged is apparent density from 0.70 to 0.80 grams per cubic centimeter, values suitable for production of automatic dishwasher detergent by the method previously described. The size analysis found for these samples, as shown in Table I, was also within an acceptable range for this use. Material of +16 mesh size was under 2% in all cases.

TABLE I

| Size | Samples % by Weight | | | | | |
|---|---|---|---|---|---|---|
| Range | A | B | C | D | E | F |
| +20 | 17.8 | 5.0 | 3.5 | 4.3 | 4.9 | 2.9 |
| −20/+40 | 55.7 | 23.8 | 24.9 | 24.3 | 21.3 | 24.9 |
| −40/+50 | 21.1 | 29.9 | 29.3 | 29.6 | 22.1 | 29.9 |
| −50/+60 | 3.6 | 20.5 | 20.7 | 20.6 | 19.1 | 15.5 |
| −60/+80 | 1.5 | 15.5 | 16.9 | 16.2 | 22.1 | 17.3 |
| −80/+100 | 0.1 | 3.2 | 3.2 | 3.2 | 6.2 | 5.5 |

TABLE I-continued

| Size | Samples % by Weight | | | | | |
|---|---|---|---|---|---|---|
| Range | A | B | C | D | E | F |
| −100 | 1.1 | 2.2 | 1.6 | 1.9 | 4.3 | 4.0 |

Analysis of STPP for Phase I and Phase II contents can be accomplished by several different techniques. X-ray powder diffraction or infrared spectroscopy may be used to determine percent by weight present of both Phases while a calorimetric method (Temperature Rise Test) is frequently used to determine percent (weight) Phase I content for routine production control. Table II includes Phase I contents of above Sample A-F as determined by X-ray diffraction.

TABLE II

| Sample | % Phase I |
|---|---|
| A | 26.2 |
| B | 58.6 |
| C | 13.4 |
| D | 34.1 |
| E | 32.4 |
| F | 29.8 |

The selection of a specific granular STPP product which will give desired performance levels in the manufacture of automatic dishwasher detergents depends basically upon its possessing hydration properties which will allow it to function efficiently as a dehydrating agent to capture free water in the formulated mixture. Hydration properties, in turn, depend on the combination of other properties such as percent Phase I content, particle distribution, and structure of individual particles. Prediction of performance from these and other basic properties would be highly complex. Manufacturer's of automatic dishwasher detergents have found the most satisfactory predictive method to be the actual preparation of product in a pilot scale simulation of their processes wherein performance criteria for specific STPP samples may be rated. In terms of emperical performance tests such as these, samples chosen from the set A-F, above, received the performance ratings shown in Table III.

TABLE III

| Sample | Suitability for ADW Manufacture |
|---|---|
| A | Unsuitable |
| D | Suitable |
| E | Suitable |
| F | Unsuitable |

Comparison of analyses and histories of these samples disclose one unexpected factor related to performance. Samples A and F were representative of production materials where considerable variation of percent Phase I had occurred over time during the runs as shown by periodic control analyses for percent Phase I. The final products were the result of combining 30 to 40% of STPP of low Phase I content (under 25% Phase I and some portion under 15%), 30 to 40% of STPP of high Phase I content (45% Phase I and higher), and the balance in the middle 25 to 45% Phase I region. Particle size distribution as shown by periodic screen analyses were essentially the same in all Phase I regions.

Efficient hydration of large STPP particles, those of +40 to 30 60 mesh size, was deemed to be an important factor in determining product performance. A hydration test was designed to study the combined effect of particle size and Phase I content of hydration phenomena. The test is conducted by adding 50 grams of a sample to 100 cc. of a solution of 40% water and 60% isopropyl alcohol in an insulated vessel at 25.0° C. The slurry is stirred for 30 minutes during which time the maximum temperature is reached and the time of such temperature is recorded. The slurry is then filtered, washed with additional isopropyl alcohol, and dried under reduced pressure at 25° C. The weight gain determines the percent hydration and a screen analysis is performed to determine the extent of particle breakdown. Results of this test on Samples A–F (Table I) are listed in Table IV.

Samples B and C were "grab" samples of plant production taken over a very short time. The percent Phase I concentration for the total samples is thus expected to represent the concentration in individual particles making up these samples within a few percent range. The more exothermic, rapid, and complete hydration of Sample B as compared to Sample C (seen in Table IV) was a consequence of the much higher Phase I content of Sample B, and would be expected from the inherent hydration properties of Phase I and Phase II. Unexpected was the effect of hydration on the large particle size fractions (+60 mesh) of these samples. At high Phase I content, Sample B exhibited pronounced breakdown to smaller particle sizes. At low Phase I content, Sample C showed little change in the large size fractions or else showed an increase, implying some agglomeration. In terms of efficiency as a "dehydrating agent", the breakdown of large particles to smaller sizes seen for Sample B would expose fresh anhydrous STPP for further reaction with free water. The lack of breakdown, or more significantly, agglomeration, seen for Sample C would tend to restrict access of free water to unhydrated STPP.

TABLE IV

| HYDRATION TEST | | | | SCREEN ANALYSIS | | | | | |
|---|---|---|---|---|---|---|---|---|---|
| Sample | Hydration | Maximum Temperature | Time (min.) | +20 | −20+40 | −40+60 | −60+80 | −80+100 | −100 |
| A | — | — | — | 17.8 | 55.7 | 24.7 | 1.5 | 0.1 | 1.1 |
| $A_h$ | 99% | 36.8° | 21 | 14.5 | 53.1 | 22.5 | 5.3 | 1.5 | 3.3 |
| B | — | — | — | 5.0 | 23.8 | 50.4 | 15.5 | 3.2 | 2.2 |
| $B_h$ | 99 | 39.2 | 12 | 2.2 | 8.1 | 30.3 | 32.6 | 15.2 | 10.6 |
| C | — | — | — | 3.5 | 24.9 | 50.0 | 16.9 | 3.2 | 1.6 |
| $C_h$ | 93 | 37.0 | 23 | 1.7 | 21.7 | 60.5 | 12.2 | 1.6 | 2.4 |
| D | — | — | — | 4.3 | 24.3 | 50.2 | 16.2 | 3.2 | 1.9 |
| $D_h$ | 98 | 37.7 | 15 | 0.4 | 5.9 | 46.7 | 19.9 | 5.0 | 21.7 |
| E | — | — | — | 4.9 | 21.3 | 41.2 | 22.1 | 6.2 | 4.3 |
| $E_h$ | 94 | 37.9 | 15 | 4.1 | 19.1 | 39.8 | 18.6 | 5.3 | 13.0 |
| F | — | — | — | 2.9 | 24.8 | 45.3 | 17.3 | 5.5 | 4.2 |
| $F_h$ | 76 | 33.1 | 15 | 1.7 | 14.9 | 46.7 | 33.4 | 1.8 | 1.5 |

Sample subscript "h" indicates results after hydration.

Reviewing the "unsuitable" Samples A and F in Table IV, Sample A is seen to be of large average particle size but displays very limited size breakdown in the +60 fractions on hydration. Sample F shows some breakdown in this size region but also shows agglomeration, resulting in the slow and incomplete hydration.

The heretofore unrecognized composition variable pointed out by these observations is that granular STPP intended for manufacture of automatic dishwasher detergents should contain only a limited amount of material that is of both large particle size and low Phase I concentration. Preferred would be 5%, or less, of the total mixture to be of both +50 mesh size and under 25% Phase I. Suitable compositions could contain up to 10% of material which is both +40 mesh size and under 20% Phase I.

A method for producing this composition and avoiding large size-low Phase I material would be to make a material of quite high percent Phase I, approaching Sample B. Such STPP could, however, overheat the automatic dishwasher detergent mixture during its initial mixing step, and cause decomposition of some components. Restriction of the overall average percent Phase I in the STPP product to 30 to 40% maximum would be necessary.

Two methods for avoiding excessive amounts of low Phase I—large particle size STPP while remaining within the overall percent Phase I limits in the granular mixture are the following.

EXAMPLE I

Low percentage Phase I STPP of −50 mesh size and high percentage Phase I of +50 mesh size are recovered from separate production runs by screening. These materials are mixed to yield a product of 30 to 40% Phase I. Thus, a fraction of at least 80% of the +50 mesh size recovered from Sample B, above, was combined in equal parts by weight with a fraction of at least 80% of the −50 mesh size recovered from Sample C. The resulting mixture was Sample D STPP rated "suitable" in Table III.

EXAMPLE II

The percentage Phase I in STPP product is closely monitored during production runs so that only material falling within a narrow range of Phase I percentage values is accepted as this particular STPP product. Preferred limits are 30 to 40% Phase I, while 25 to 45% would be acceptable. Limits are obtained by close calciner control and rejection of any off-limit material. Thus, Sample E was prepared by combining only granular STPP that fell within a 30 to 40% Phase I limit so that only a few percent of the total would consist of STPP granules of higher or lower percent Phase I. This sample was rated "suitable" in Table III.

In both Examples I and II, the overall average of Phase I is within the 30 to 40% desired range. The distribution of particle size of the STPP product is greater than 80% in the −20/+100 mesh fraction with less than 10% in the +20 mesh fraction and less than 10% in the −100 mesh fraction. The preferred distribution would be greater than 90% in the −20/+100 fraction and less than 5% in each of the +20 and −100 mesh fractions. In all cases, the +14 mesh material should not exceed 1% of the total product.

While I have shown and described particular embodiments of my invention, modifications and variations thereof will occur to those skilled in the art. I wish it to be understood, therefore, that the appended claims are intended to cover such modifications and variations which are within the true scope and spirit of my invention.

What is claimed is:

1. A process for preparing a STPP composition having an apparent density of 0.7 gm/cm$^3$ to 0.9 gm/cm$^3$, comprising blending equal parts by weight of a. a granular anhydrous STPP having a maximum of 25% Phase I, at least 80% being −50 mesh, with b. a granular anhydrous STPP having a minimum of 45% Phase I, at least 80% being +50 mesh, to obtain a STPP composition which contains about 30% to about 40% Phase I STPP with not more than 5% of the +50 mesh STPP being less than 25% STPP Phase I, with less than 10% being +20 mesh and less than 10% being −100 mesh.

2. The process of claim 1 wherein the total mixture contains less than 5% of the particle −100 mesh in size.

3. The process of claim 1 wherein the total mixture contains less than 5% of the particles −100 mesh in size.

4. The process of claim 1 wherein the total mixture contains 30 to 40% Phase I STPP, less than 5% of the mixture is +20 mesh and less than 5% is −100 mesh.

* * * * *